United States Patent [19]

Mark

[11] 4,365,855

[45] Dec. 28, 1982

[54] STORAGE FACILITY SUCH AS A FILE HAVING A FLEXIBLE ROTATABLE COVER

[76] Inventor: Edward H. Mark, U.S. 31 North, Niles, Mich. 49120

[21] Appl. No.: 150,716

[22] Filed: May 19, 1980

[51] Int. Cl.[3] ..... E06B 9/14

[52] U.S. Cl. ..... 312/297; 312/245; 312/263

[58] Field of Search ..... 312/297, 263, 138 R, 312/324, 240, 245; 108/152; 52/127, 285, 309.2, 309.7; 160/206

[56] References Cited

U.S. PATENT DOCUMENTS

| | | | |
|---|---|---|---|
| 813,679 | 2/1906 | Vetter | 312/297 |
| 970,832 | 9/1910 | Jones et al. | 312/297 |
| 3,496,889 | 2/1970 | Protzmann et al. | 312/245 |
| 3,771,847 | 11/1973 | Aylworth | 312/245 |
| 3,784,273 | 1/1974 | Nikolai | 312/263 |
| 3,807,825 | 4/1974 | Snethen | 312/297 |
| 3,837,041 | 9/1974 | Modert et al. | 312/297 |
| 3,936,113 | 2/1976 | Anderson | 312/297 |
| 4,279,454 | 7/1981 | Koiso et al. | 312/297 |

FOREIGN PATENT DOCUMENTS

| | | | |
|---|---|---|---|
| 1378237 | 10/1964 | France | 312/263 |
| 1532625 | 11/1978 | United Kingdom | 312/245 |

*Primary Examiner*—Victor N. Sakran

*Attorney, Agent, or Firm*—Oltsch, Knoblock & Hall

[57] ABSTRACT

A storage facility, such as a file or bookcase, which includes spaced parallel end plates supporting a brace part therebetween. A flexible cover extends between and is supported by the end plates so as to be rotatable entirely about the brace part.

3 Claims, 7 Drawing Figures

STORAGE FACILITY SUCH AS A FILE HAVING A FLEXIBLE ROTATABLE COVER

SUMMARY OF THE INVENTION

This invention relates to a storage facility adapted for suspension from a verticle support and will pertain as an example to a file or bookcase having a roll top.

In the storage facility of this invention spaced parallel end plates support a brace part which extends therebetween. The end plates carry and support a flexible cover or roll top which is rotatable entirely about the brace part. Depending upon the position of the cover about the brace part, the storage facility can serve as a tub file, front loading file or a bookshelf. The storage facility is secured to the vertical support, which may constitute a wall, at its end plates so as to permit the flexible cover to rotate 360° about the brace part which extends between the end plates. In this manner, the storage facility can be utilized for multiple purposes depending upon the orientation of the flexible cover.

Accordingly, it is an object of this invention to provide a suspendable office storage facility which can be utilized as a file or book case.

Another object of this invention is to provide a storage file having a flexible cover which is rotatable entirely about the body of the file.

Still another object of this invention is to provide a multiple purpose suspended storage facility which is of simple and efficient operation.

And still another object of this invention is to provide a safe and strong securement device by which a storage facility such as a file or a bookshelf may be suspended from a wall member.

Other objects of this invention will become apparent upon a reading of the invention's description.

BRIEF DESCRIPTION OF THE DRAWINGS

A preferred embodiment of the invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It is chosen and described in order to explain the invention and its application and practical use to enable others skilled in the art to best utilize the invention.

Figure 6:
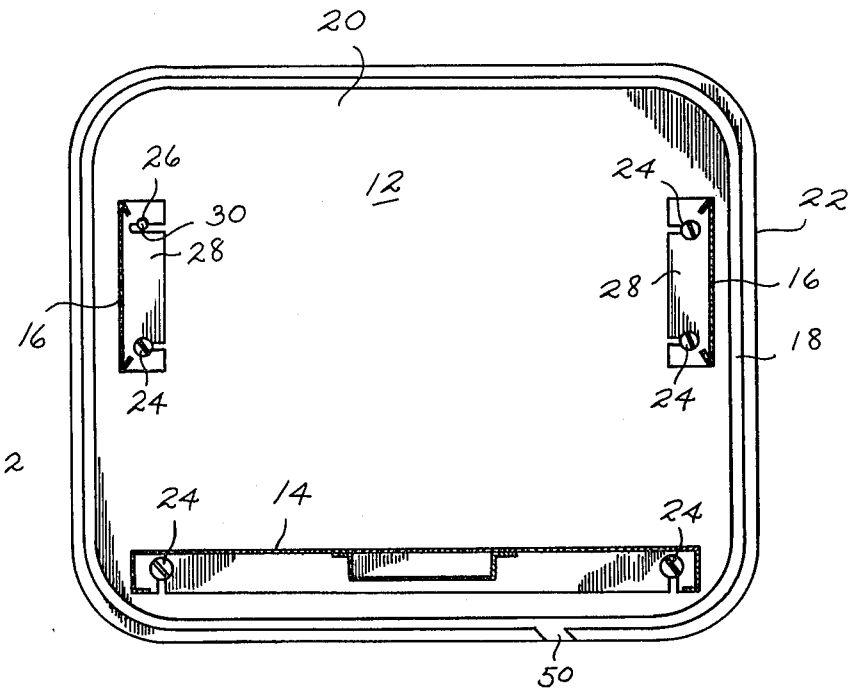
FIG. 6 is a cross sectional view of a storage facility taken adjacent one of the end plates but with a flexible cover removed for purposes of illustration.

Storage facility 10 includes a pair of laterally spaced, parallel end plates or walls 12 interconnected by one or more brace members, namely, bottom wall part 14 and side rails 16. End plates 12 are of a four edge construction, each having a continuous groove 18 formed in its inner side face 20. Grove 18 generally parallels in a spaced relationship the end edge 22 of each plate 12. Wall part 14 and side rails 16 of storage facility 10 are connected by screws 24 or similar type fasteners within that area of each inner side face 20 of end plates 12 circumscribed by groove 18, as best seen in FIG. 6. In FIG. 6 one attachment screw 24 of a side rail 16 has been omitted to illustrate the notch 26 formed in the attachment slot of each end flange 28 of the side rail 16. A notch 26 is formed in each attachment slot in end rails 16 so as to allow the rails to nest upon the attachment screws 24, which are turned into pre-drilled holes 30 (only one shown) in side faces 20 of plates 12. Side rails 16 are utilized to support or retain file material within storage facility 10 and, if desired, can be adjusted laterally by simply loosening screws 24 and lifting the side rails from nesting engagement at notches 26 with screws 24. Once the correct spacing between side rails is obtained to accommodate a particular file or card, screws 24 need only be tightened.

A flexible cover 32 extends between end plates 12. Cover 32 is supported by plates 12 with its end edges fitting guidably within grooves 18 in the end plates. With grooves 18 extending entirely about the peripheral edges of end plates 12, cover 32 may be rotated 360° around wall part 14 and side rails 16 and stopped in any of a variety of positions. Cover 32 may be formed of a plurality of interconnected slats or of a flexible shape-retaining material.

Figure 7:
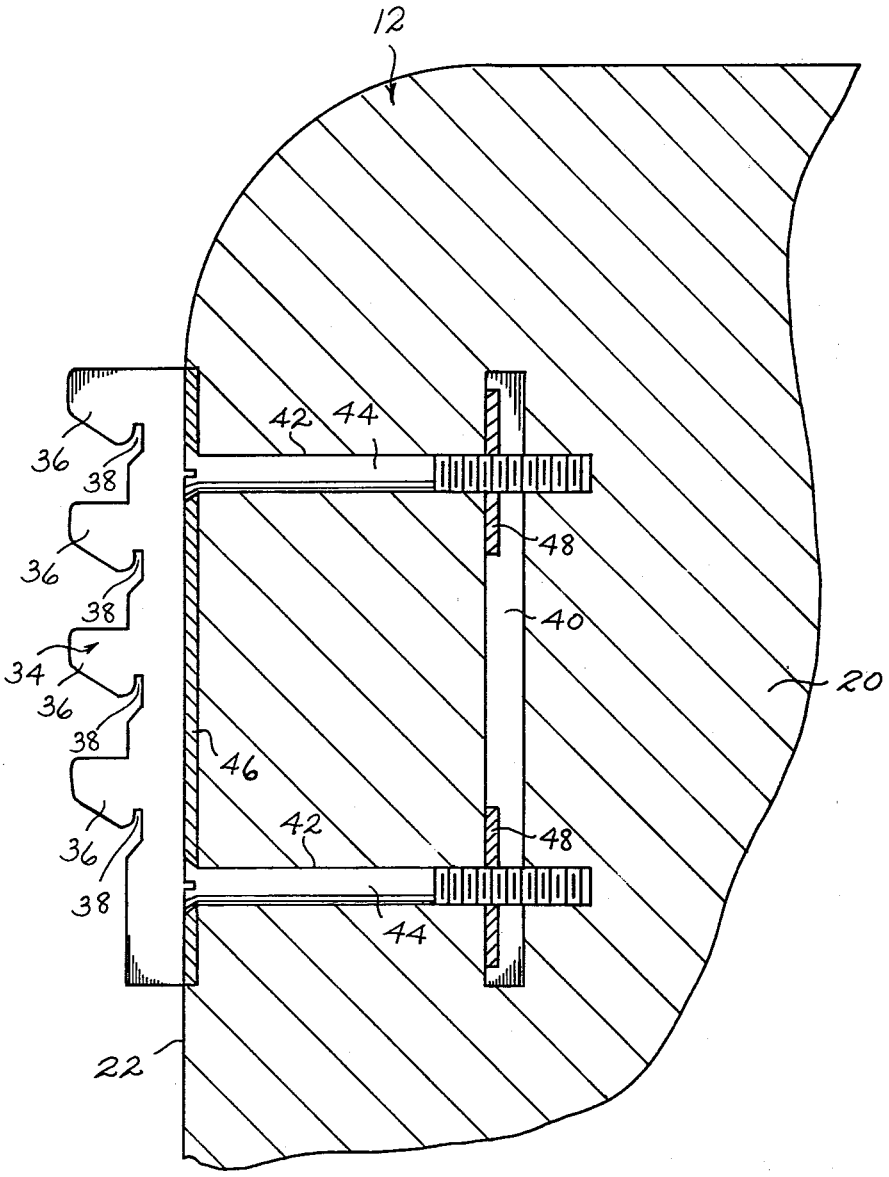
FIG. 7 is a sectional view of a mounting bracket shown fastened to an end plate of the storage facility.

Storage facility 10 is adapted for connection to a wall or similar vertical support. This is accomplished, as best illustrated in FIG. 7, through the use of a notched catch bracket 34 connected to each end plate 12. Each bracket 34 is adapted to fit at its tabs 36 into accommodating slots in a vertical support with the edge of the support slots fitting into the accommodating bracket slots 38. The precise construction of bracket 34 and the manner it connects to a vertical support can vary. To secure catch bracket 34 to each end plate 12 at its end edge 22, a slot 40 is first formed within inner side face 20 of the end plate. Slot 40 generally parallels the end edge 22 where bracket 34 will be located. Bores 42 are drilled from end edge 22 into slot 40. Attachment screws 44 are fitted through accommodating openings in flange 46 of each bracket 34 and into bores 42. A nut 48, which is preferably square in configuration is fitted into slot 40 with each screw 44 being turned through the nut. The depth of each slot 40 is such each nut 48 is preferably entirely recessed within inner side face 20 of the end plate yet engages the base of the slot as a screw 44 is tightened and turned through the nut. In this manner, each nut 48 is prevented from turning relative to the screw, which when tightened serves to pull or clamp each bracket 34 firmly against end edge 22 of its connecting end plate.

Figure 2:
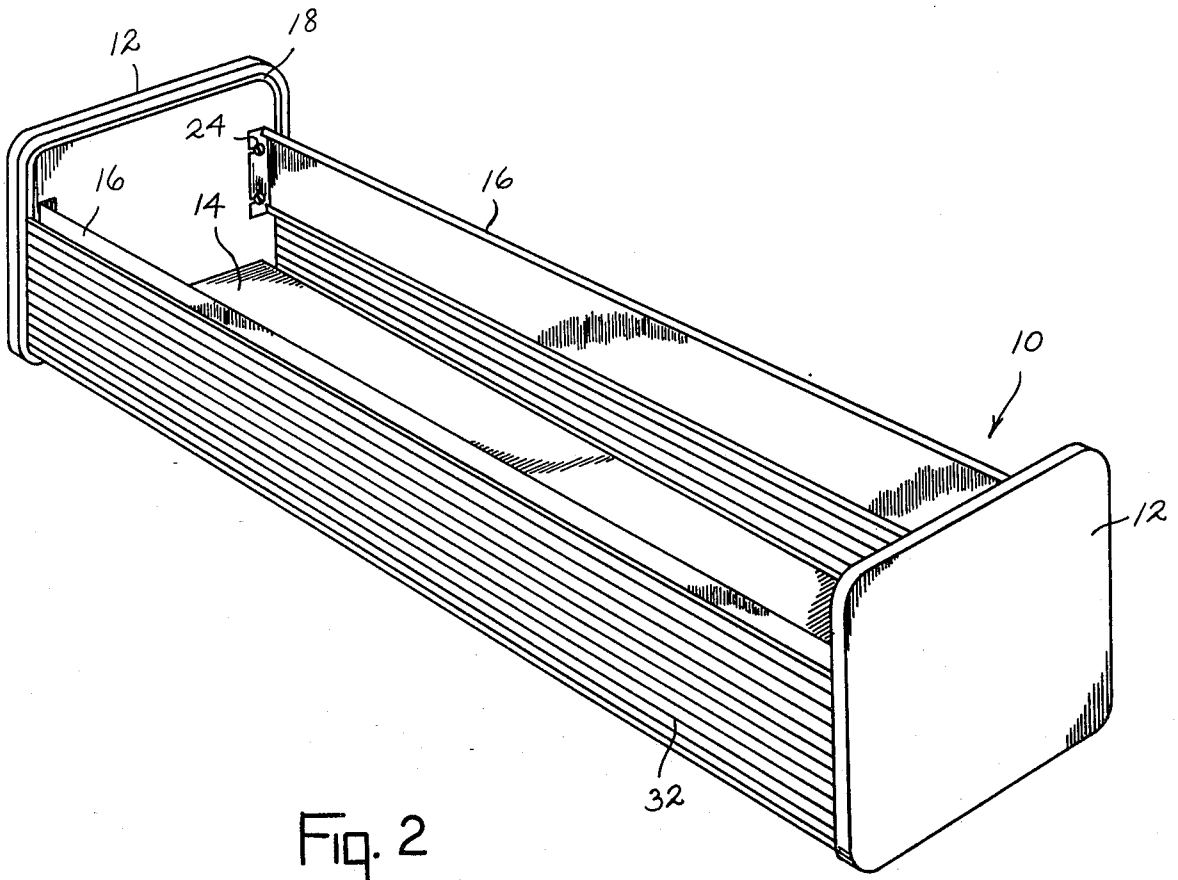
FIG. 2 is a view of the storage facility of FIG. 1 being used as a tub file with its flexible cover opened.
Figure 3:
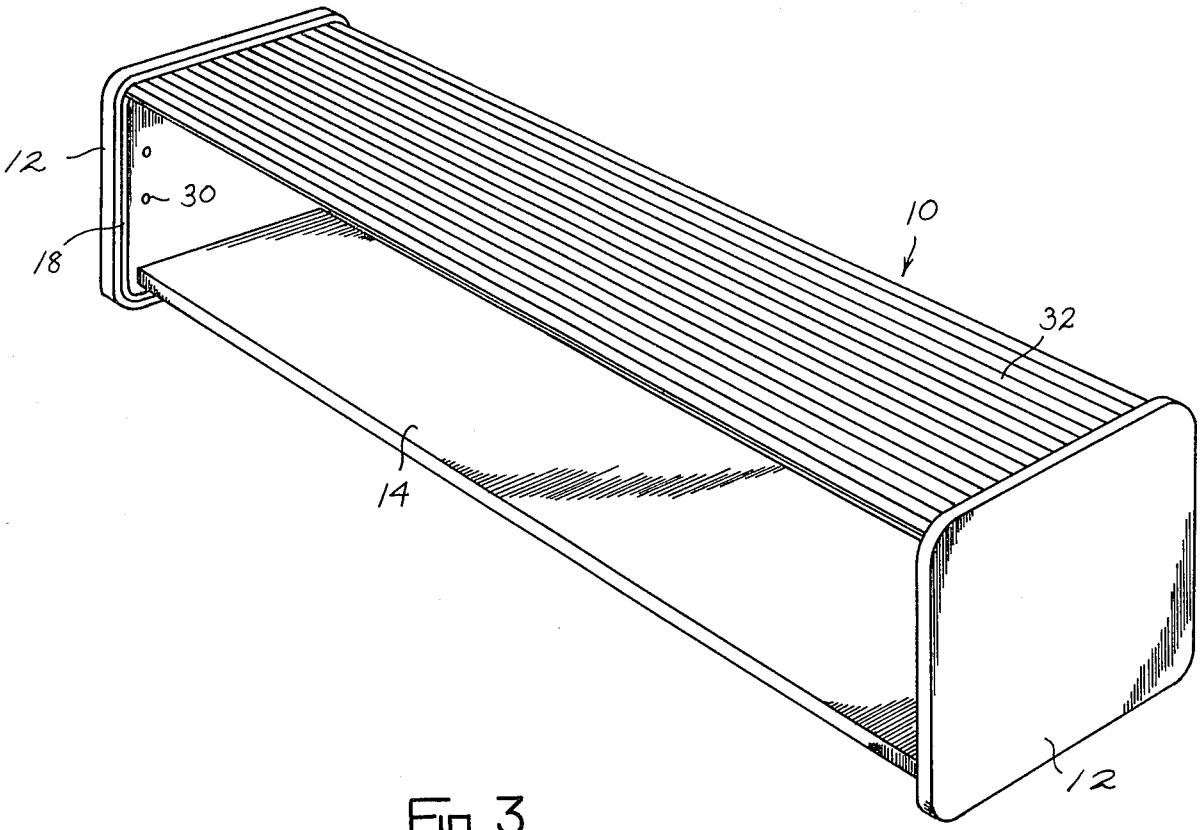
FIG. 3 is a perspective view of the storage facility shown as being used as a bookshelf.
Figure 5:
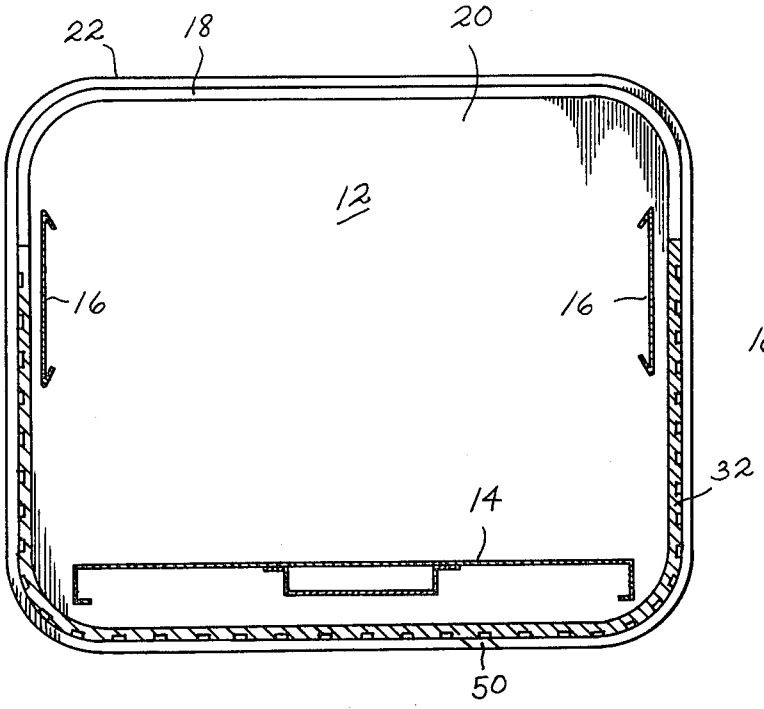
FIG. 5 is a cross sectional view of the storage facility taken through the flexible cover in the position illustrated in FIG. 2.

Storage facility 10 above described can be utilized for multiple purposes such as a tub file, as shown in FIG. 2 or a bookshelf, as shown in FIG. 3, in which case one side rail 16 would be removed to allow lateral access to wall part 14. The width of cover 32 is preferably such that it extends about two and at least a part of a third of the four sides of storage facility 10. This enables cover 32 in its open position to extend around storage facility 10 as shown in FIGS. 2 and 5 when the facility is used as a tub file or around the top and back of the storage facility as shown in FIG. 3 when the facility is used as a book or storage shelf. An angled slot 50 is formed in inner side face 20 of each end plate 12 at the bottom of the plate as illustrated in FIGS. 5 and 6 to enable cover 32 to be removed and replaced without the necessity of completely disassembling the storage facility.

Figure 1:
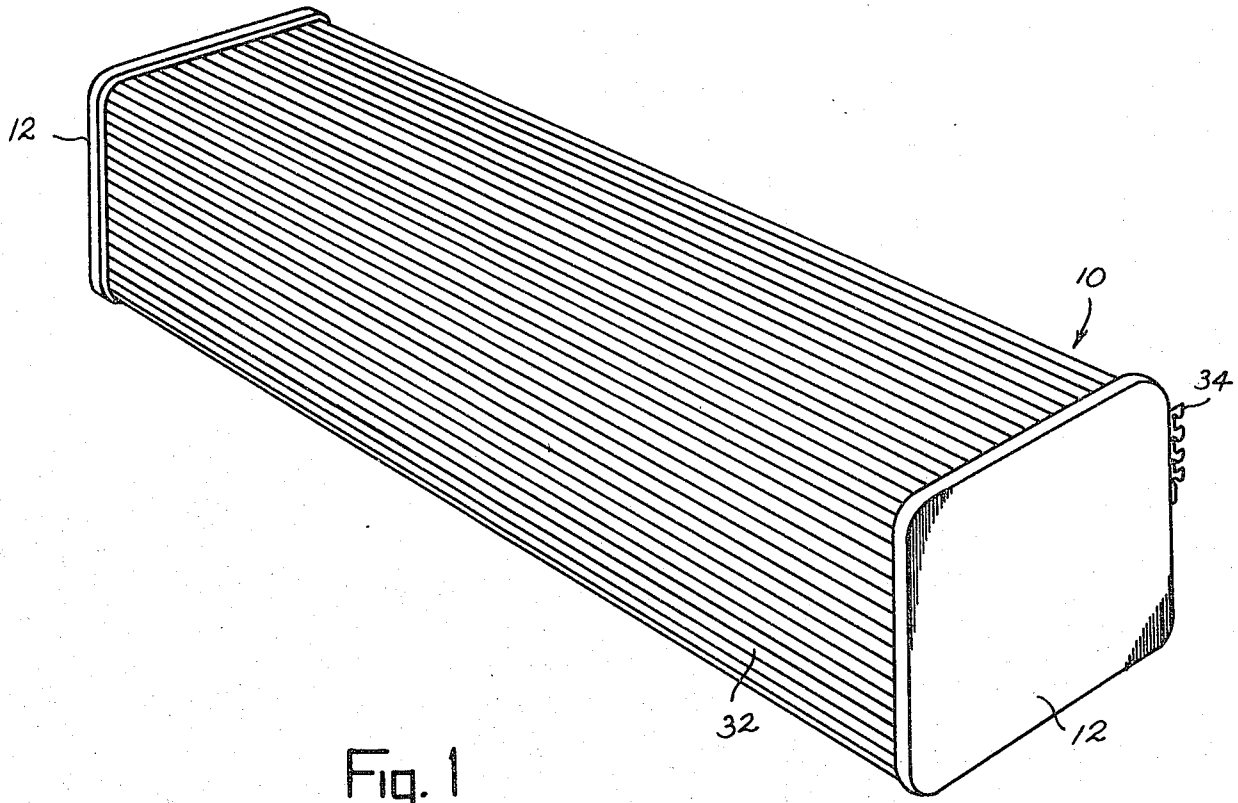
FIG. 1 is a perspective view of the facility showing its flexible cover closed.
Figure 4:
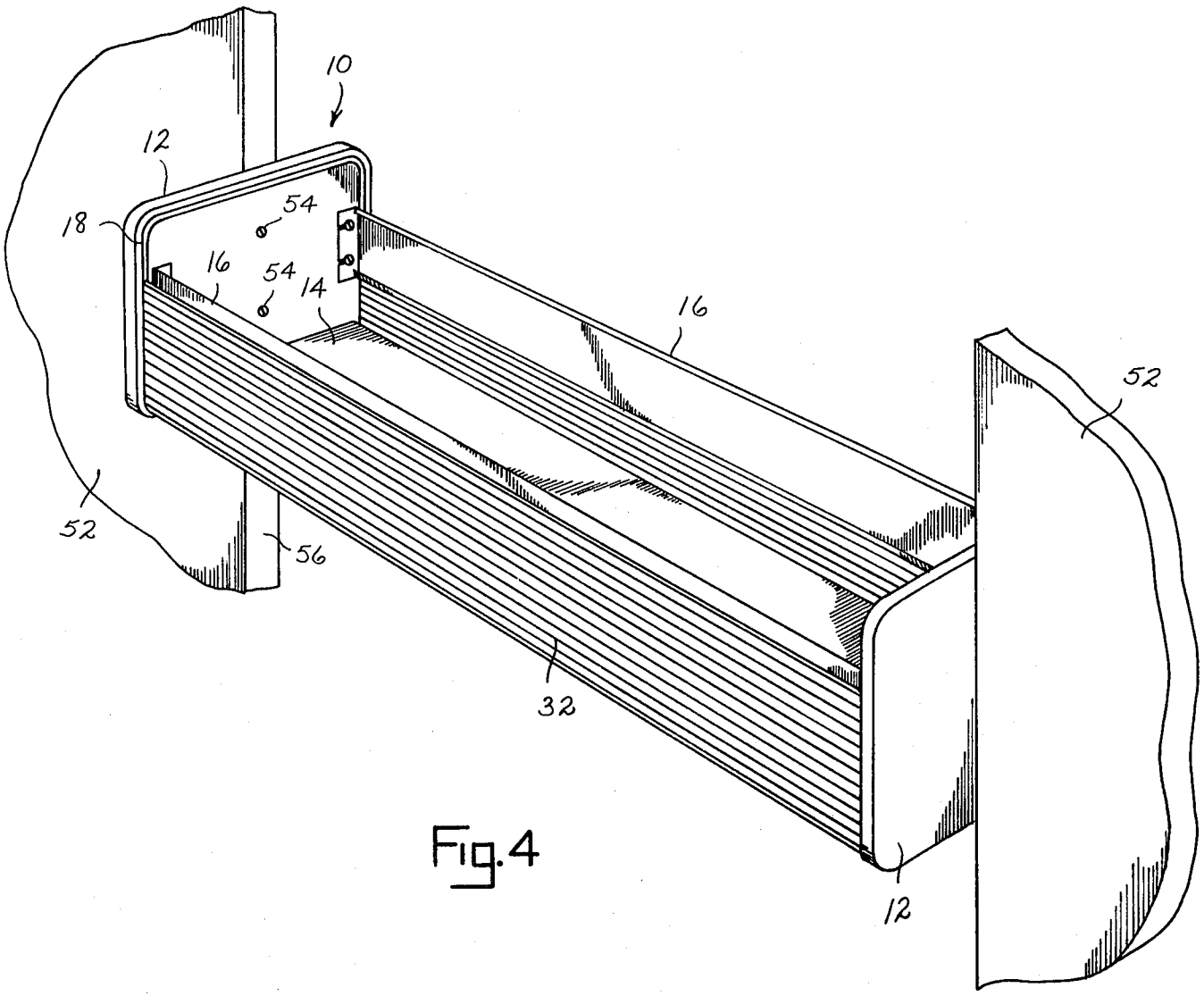
FIG. 4 is a perspective view of the storage facility connected between two wall partitions which enables the facility to be used as a tub file from either side.

In FIG. 4 the tub file arrangement of the storage facility illustrated in FIG. 2 is shown connected between two wall partitions 52. In this orientation storage facility 10 can be utilized from both the front and the back of the facility. Cover 32 utilized with the storage facility shown in FIG. 4 should be sufficiently wide to cover three sides of the facility when shifted into its closed position illustrated in FIG. 1. When used as illustrated in FIG. 4, the storage facility would not include the catch brackets 34 normally connected to each of the end plates 12. Screws 54 can be inserted through end plates 12 and turned into end edges 56 of the wall sections 52.

It is to be understood that the invention is not to be limited to the details above given, but may be modified within the scope of the appended claims.

What I claim is:

1. A storage facility comprising a pair of spaced parallel end plates having opposing side faces, a brace part extending between said end plates from one side face to the other side face thereof, each end plate having a peripheral continuous groove formed in its side face circumscribing said brace part at the end plate, a flexible cover extending between said end plates and including peripheral edges each fitted within a said peripheral groove, means for connecting said end plates to a vertical support whereby the storage facility will be suspended for use, each peripheral groove constituting guide means wherein said cover can be rotated about said brace part into various operative positions, said cover constituting at least two sides of said storage facility in all operative positions of the cover, each end plate including an end edge, said means for connecting said end plates including a slot formed in each plate at its side face paralleling said plate end edge, a bore extending from said plate end edge to said slot, catch means for supporting engagement with said vertical support, a threaded screw connecting said catch means to said end plate at its end edge and extending through said bore into said slot, a nut turned onto said screw within said slot in compression with said end plate to secure the screw within said bore.

2. The storage facility of claim 1 wherein said cover constitutes three sides of said storage facility in all operative positions of the cover.

3. The storage facility of claim 1, wherein said brace part is a bottom wall, said wall for providing support for materials stored within said facility.

* * * * *